US011288947B2

(12) United States Patent
Saunders

(10) Patent No.: US 11,288,947 B2
(45) Date of Patent: Mar. 29, 2022

(54) MANUAL CALL POINT DEVICE WITH SENSOR

(71) Applicant: ELECTRONIC MODULAR SERVICES LTD., Kent (GB)

(72) Inventor: Edward Saunders, Kent (GB)

(73) Assignee: ELECTRONIC MODULAR SERVICES LTD., Kent (GB)

( * ) Notice: Subject to any disclaimer, the term of this patent is extended or adjusted under 35 U.S.C. 154(b) by 0 days.

(21) Appl. No.: 17/057,315

(22) PCT Filed: Oct. 11, 2019

(86) PCT No.: PCT/EP2019/077659
§ 371 (c)(1),
(2) Date: Nov. 20, 2020

(87) PCT Pub. No.: WO2020/074731
PCT Pub. Date: Apr. 16, 2020

(65) Prior Publication Data

US 2021/0201655 A1 Jul. 1, 2021

(30) Foreign Application Priority Data

Oct. 12, 2018 (EP) ..... 18275162

(51) Int. Cl.
*G08B 25/12* (2006.01)

(52) U.S. Cl.
CPC ..... *G08B 25/12* (2013.01)

(58) Field of Classification Search
CPC ..... G08B 25/12
See application file for complete search history.

(56) References Cited

U.S. PATENT DOCUMENTS 3,877,005 A 4/1975 Apgar
3,986,184 A 10/1976 Castanino et al.
(Continued)

FOREIGN PATENT DOCUMENTS

CN 103218898 A 7/2013
DE 9408898 U1 9/1995
(Continued)

OTHER PUBLICATIONS

European Search Report Application No. EP18275162; dated Apr. 2, 2019; pp. 7.
(Continued)

*Primary Examiner* — Travis R Hunnings
(74) *Attorney, Agent, or Firm* — Cantor Colburn LLP

(57) ABSTRACT

A manual call point (MCP) (130) is provided and includes a housing (210), a frangible element (220) disposed on the housing (210) to be accessible to and operable by a user and a control system (120). The control system (120) is disposed within the housing (210). The control system (120) includes a detector (232) configured to detect frangible element (220) operations, a sensor (233) configured to measure forces applied to the frangible element (220) and a processing unit (234) configured to initiate an alarm responsive to the detector (232) detecting a frangible element (220) operation, to determine whether the measured forces are indicative of an event and to generate a report in accordance with determination results.

14 Claims, 2 Drawing Sheets

(56) References Cited

U.S. PATENT DOCUMENTS

| | | | | |
|---|---|---|---|---|
| 4,359,719 | A | 11/1982 | Schwarzer | |
| 5,317,305 | A | 5/1994 | Campman | |
| 8,026,825 | B2 | 9/2011 | Santos | |
| 9,277,121 | B2 | 3/2016 | Kozko | |
| 9,286,790 | B2 | 3/2016 | Lyman et al. | |
| 9,287,064 | B2 | 3/2016 | Dedina | |
| 9,922,538 | B2 | 3/2018 | Kim | |
| 2009/0027220 | A1* | 1/2009 | Pichard ..... | G08B 25/12 340/665 |
| 2015/0042472 | A1 | 2/2015 | Muetzel et al. | |
| 2017/0278383 | A1 | 9/2017 | Dimberg et al. | |

FOREIGN PATENT DOCUMENTS

| | | | |
|---|---|---|---|
| EP | 2093735 | A1 | 8/2009 |
| EP | 3637382 | A1 | 4/2020 |
| FR | 2835756 | A1 | 8/2003 |
| JP | H1166478 | A | 3/1999 |
| KR | 101713414 | B1 | 3/2017 |

OTHER PUBLICATIONS

International Search Report Application No. PCT/EP2019/077659; dated Jan. 2, 2020; pp. 8.
Written Opinion Application No. PCT/EP2019/077659; dated Jan. 2, 2020; pp. 6.

* cited by examiner

MANUAL CALL POINT DEVICE WITH SENSOR

CROSS-REFERENCE TO RELATED APPLICATIONS

This application is a National Phase of PCT Application No. PCT/EP2019/077659 filed Oct. 11, 2019 which claims the benefit of priority to European Application No. 18275162.8 filed Oct. 12, 2018, the disclosure of which is incorporated herein by reference in its entirety.

BACKGROUND

The following description relates to manual call point devices and, more particularly, to a manual call point device with a sensor, such as a micro-electromechanical systems (MEMS) accelerometer, for diagnostics and logging of maintenance testing.

Manual fire alarm activation is typically achieved through the use of a pull station in the United States and Canada or a manual call point (MCP) in Europe, Australia and Asia which sounds an evacuation alarm for the relevant building or zone.

In Europe, Australia, New Zealand and Asia, pull stations, such as MCPs, allow building occupants to signal that a fire or other emergency exists within the building. They are usually connected to a central fire alarm panel which is in turn connected to an alarm system in the building and often to a local fire brigade dispatcher as well.

MCPs are generally manually operated but can have automatic functionality as well. Manual operations of MCPs typically include the simple press of a button or the braking of glass to reveal a button that can be pressed. MCPs can include an indicator to provide for visual location of the MCP and to allow for the identification of the unit that triggered an alarm. This indicator can be manually reset with a key.

It has been found that there are examples of MCP activations in the field that lead to customer sites to be evacuated where the customer claims no user interaction occurred with the product. This issue cannot be addressed unless closed circuit television (CCTV) is employed at each location of an MCP to provide for proof of user interaction or lack thereof. Since such CCTV deployment is unrealistic, there currently is no way of determining what caused a particular activation of an MCP at a customer site.

BRIEF DESCRIPTION

According to one aspect of the disclosure, a manual call point (MCP) is provided and includes a housing, a frangible element disposed on the housing to be accessible to and operable by a user and a control system. The control system is disposed within the housing. The control system includes a detector configured to detect frangible element operations, a sensor configured to measure forces applied to the frangible element and a processing unit configured to initiate an alarm responsive to the detector detecting a frangible element operation, to determine whether the measured forces are indicative of an event and to generate a report in accordance with determination results.

In accordance with additional or alternative embodiments, the housing may be formed to define a test key point into which a test key is insertible for an MCP test and an MCP reset.

In accordance with additional or alternative embodiments, a circuit board may be disposed within the housing with the detector, the sensor and the processing unit disposed thereon.

In accordance with additional or alternative embodiments, the detector may include a micro-switch.

In accordance with additional or alternative embodiments, the sensor may include a micro-electromechanical systems (MEMS) accelerometer.

In accordance with additional or alternative embodiments, the frangible element may be movable in the frangible element operation from an initial position to a final position within the housing.

In accordance with additional or alternative embodiments, the sensor may measure forces applied to the frangible element in a first direction, which may be in a plane of frangible element movement, and a second direction, which may be transverse to the first direction.

In accordance with additional or alternative embodiments, the processing unit may be configured to determine whether at least magnitudes and directions of the forces applied to the frangible element are indicative of intentional user operation of the frangible element toward alarm initiation, an MCP test or reset, a malicious operation, and an external incident.

In accordance with another aspect of the disclosure, an alarm system is provided for deployment in a space. The alarm system may include a central alarm and control system and manual call points (MCPs) respectively deployed throughout the space. Each MCP may include a housing, a frangible element disposed on the housing to be accessible to and operable by a user and a control system disposed within the housing. The control system may include a detector configured to detect an operation of the frangible element, a sensor configured to measure forces applied to the frangible element and a processing unit communicative with the central alarm and control system and configured to cooperatively initiate an alarm responsive to the detector detecting a frangible element operation with the central alarm and control system, to determine whether the measured forces are indicative of an event and to generate a report in accordance with determination results.

In accordance with additional or alternative embodiments, the housing may be formed to define a test key point into which a test key is insertible for an MCP test and an MCP reset.

In accordance with additional or alternative embodiments, a circuit board may be disposed within the housing and the detector, the sensor and the processing unit may be disposed thereon.

In accordance with additional or alternative embodiments, the detector may include a micro-switch.

In accordance with additional or alternative embodiments, the sensor may include a micro-electromechanical systems (MEMS) accelerometer.

In accordance with additional or alternative embodiments, the frangible element may be movable in the frangible element operation from an initial position to a final position within the housing.

In accordance with additional or alternative embodiments, the sensor may measure forces applied to the frangible element in a first direction, which may be in a plane of frangible element movement, and a second direction, which may be transverse to the first direction.

In accordance with additional or alternative embodiments, the processing unit may be configured to determine whether at least magnitudes and directions of the forces applied to the frangible element are indicative of intentional user operation of the frangible element toward alarm initiation, an MCP test or reset, a malicious operation and an external incident.

According to yet another aspect of the disclosure, a manual call point (MCP) operational method is provided and includes detecting an operation of a frangible element, measuring forces applied to the frangible element during the operation, determining whether the measured forces are indicative of an event and generating a report in accordance with results of the determining.

In accordance with additional or alternative embodiments, the frangible element may be movable during the operation from an initial position to a final position within the housing and the measuring of the forces applied to the frangible element during the operation may include measuring the forces applied in a first direction, which may be in a plane of frangible element movement and measuring the forces applied in a second direction, which may be transverse to the first direction.

In accordance with additional or alternative embodiments, the determining may include determining whether at least magnitudes and directions of the forces applied to the frangible element are indicative of intentional user operation of the frangible element toward alarm initiation, an MCP test or reset, a malicious operation and an external incident.

In accordance with additional or alternative embodiments, the determining may include comparing the at least magnitudes and directions to historical magnitudes and directions of intentional user operation of the frangible element toward alarm initiation, an MCP test or reset, a malicious operation and an external incident These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

As will be described below, an MCP is provided with a sensor to determine what caused a particular activation of the MCP. In an exemplary case, a state of a frangible element of the MCP can be detected using a MEMS accelerometer that is installed on a printed circuit board assembly (PCSA) of the MCP along with a microcontroller so that the MEMS accelerometer can be connected to and communicative with the microcontroller. The small size of the MEMS accelerometer allows for its installation without a substantial modification of the MCP and can be disposed in a low power mode so as to extend MCP battery life. The MEMS accelerometer will generally operate by measuring forces applied to the MCP components and to determine whether the MCP is being activated intentionally or not during a test or an actual incident.

Figure 1:
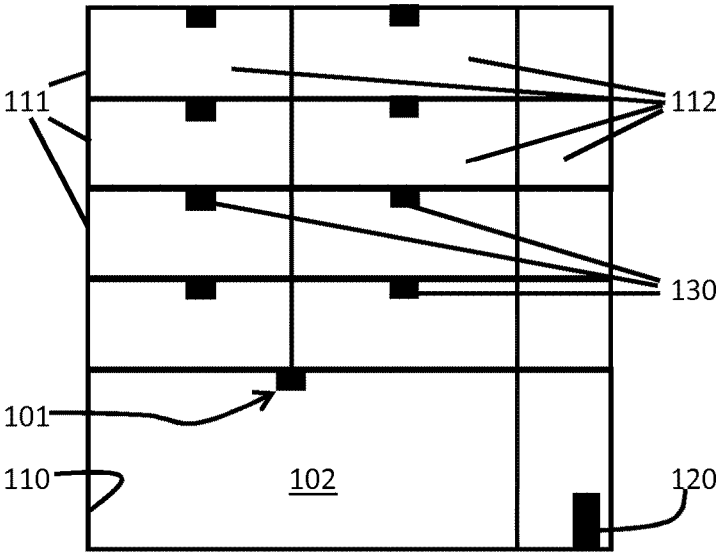
FIG. 1 is a side schematic illustration of a structure in accordance with embodiments.

With reference to FIG. 1, an alarm system 101 is provided for deployment in a space 102, such as an interior of a building or structure 110. In the case of the alarm system 101 being deployed in a structure 110, it is to be understood that the structure 110 can be a multi-level structure with multiple floors 111 and common and private areas 112 on each floor 111. The alarm system 101 includes a central alarm and control system 120 and MCPs 130. The central alarm and control system 120 can include a central server or computing device that is communicative with each of the MCPs 130 as well as other external servers or computing devices and any other alarm system components of the alarm system 101 that are deployed throughout the structure 110 (e.g., fire, smoke or carbon monoxide detectors, visual and audible alarms, communications networks, etc.). The MCPs 130 are respectively deployed throughout the spaces of the common and private areas 112 on each floor 111.

Figure 2B:
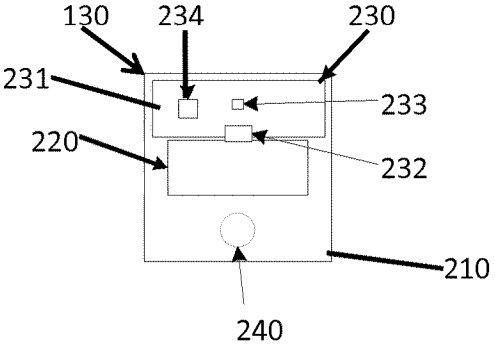
FIG. 2B is a back view of the MCP of FIG. 2A.
Figure 2A:
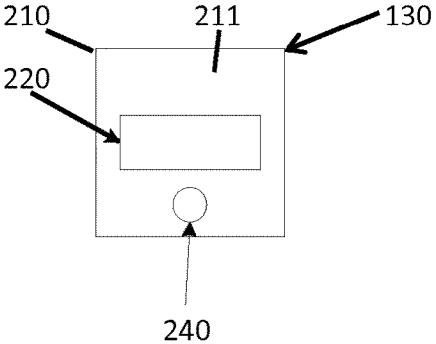
FIG. 2A is a front view of a manual call point (MCP) of an alarm system of the structure of FIG. 1.
Figure 3:
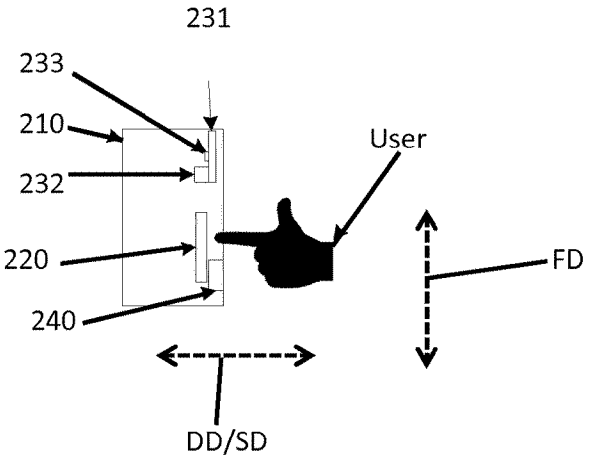
FIG. 3 is a side view of an illustration of an operation of the MCP of FIGS. 2A, 2B and 2C.
Figure 2C:
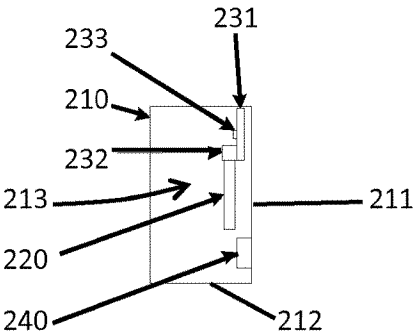
FIG. 2C is a side view of the MCP of FIGS. 2A and 2B.

With reference to FIGS. 2A, 2B and 2C, each MCP 130 includes a housing 210, a frangible element 220 and a control system 230. The housing 210 can be provided as a rigid or semi-rigid housing with at least a front face 211 and sidewalls 212 that define, with the front face 211, an interior 213. The frangible element 220 is disposed on the housing 210 to be accessible to a user and to be operable by the user during an event, such as a fire or another similar emergency. The control system 230 is at least partially disposed within the housing. The control system 230 includes a circuit board 231 and a detector 232, a sensor 233 and a processing unit 234 supportively disposed on the circuit board 231. The detector 232 can include or be provided as a micro-switch and is configured to detect an operation of the frangible element 220 (to be described below with reference to FIG. 3). The sensor 233 can include or be provided as a MEMS accelerometer or another suitable, small-sized sensor and is configured to measure forces applied to the frangible element 220. The processing unit 234 can include or be provided as a micro-controller unit (MCU) that is supportively disposed on the circuit board 231.

The housing 210 can also be formed to define a test key point 240 into which a test key is insertible for execution of an MCP test and for execution of an MCP reset.

In accordance with further embodiments, each MCP 130 may also include a local power source, such as a battery. The control system 230 can be operable in a low or no power mode that does not drain the battery and at least allows for a long or extended battery life With continued reference to FIG. 2C and with additional reference to FIG. 3, an operation of the frangible element 220 by the user during the event can involve the user pressing onto the frangible element 220 in the depth direction DD of the housing 210 and subsequently moving the frangible element 220 from an initial position (see FIG. 2B) to a final position (see FIG. 3) within the housing 210. When the frangible element 220 is in the initial position, the frangible element 220 can be connected to the detector 232 whereby the movement of the frangible element 220 away from the initial position causes the connection between the frangible element 220 and the detector 232 to break such that the detector 232 can detect the operation of the frangible element 220. The final position of the frangible element 220 can be proximate to the test key point 240 with the movement of the frangible element 220 from the initial position to the final position being directed downwardly in the illustrated embodiment.

The sensor 233 can be configured to measure forces applied to the frangible element 220 during the operation thereof in a first direction FD, which is defined to be in or parallel with a plane of the movement of the frangible element 220, and a second direction SD, which is defined to be transversely oriented or perpendicular relative to the first direction FD. In accordance with embodiments, the frangible element 220 can be at least slightly deformable under most conditions and user-applied pressures in a way that can be sensed by the sensor 233.

Figure 4:
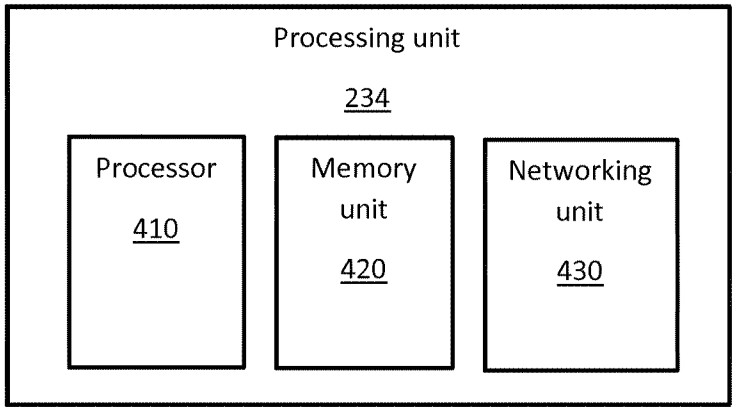
FIG. 4 is a schematic diagram of a control system of an MCP in accordance with embodiments.

With reference to FIG. 4, the processing unit 234 is communicative with the central alarm and control system 120 (see FIG. 1) and is configured to cooperatively or non-cooperatively initiate an alarm responsive to the detector 232 detecting an operation of the frangible element 220 with or without the central alarm and control system 120. The processing unit 234 is further configured to determine whether the measured forces sensed by the sensor 233 are indicative of a predefined event or incident and to generate a report in accordance with results of the determination.

As shown in FIG. 4, the processing unit 234 includes at least a processor 410, a memory unit 420 and a networking unit 430 by which the processor 410 is communicative with the detector 232, the sensor 233 and the central alarm and control system 120 (see FIG. 1). The memory unit 420 has executable instructions and, in some cases, may have certain historical data stored thereon. The historical data can be stored in the memory unit 420, a corresponding memory unit of the central alarm and control system 120 or another remote database and associates measured forces that have been applied to the frangible element 220 or to other frangible elements with different types of events or incidents (e.g., intentional user operations of frangible elements toward alarm initiation, MCP tests or resets, malicious operations or false alarms and external incidents, such as earthquakes).

The executable instructions are readable and executable by the processor 410 such that, when the processor 410 reads and executes the executable instructions, the executable instructions cause the processor 410 to be receptive of a signal from the detector 232 so that an alarm can be initiated and to be receptive of measurements of at least the magnitudes, directions and, in some cases, the frequencies of the forces applied to the frangible element 220 from the sensor 233. With the measurements received from the sensor 233, the executable instructions can further cause the processor 410 to optionally compare the measurements to corresponding measured forces that have previously been applied to the frangible element 220 or to other frangible elements during known historical events (e.g., intentional user operations of frangible elements toward alarm initiation, MCP tests or resets, malicious operations or false alarms and external incidents, such as earthquakes) and to determine, from the measurements themselves or from results of the comparison, whether the measurements are indicative of a predefined event.

For example, an intentional operation of the frangible element 220 by a user during an actual fire or emergency in the structure 110 of FIG. 1 would be expected based on empiric or historical experience to have a high magnitude and to be directed into the frangible element 220 with a slight downward pulling force. On the other hand, forces applied by the user during a malicious operation of the frangible element 220 might have lesser amplitudes (for lack of panic). Forces applied to the frangible element 220 during an MCP test or an MCP reset would have unique and characteristic measurements whereas forces applied to the frangible element 220 during an earthquake might have a unique frequency that can be sensed.

Generation of the report by the processing unit 234 can be automatic or upon request by an operator and/or the central alarm and control system 120 (see FIG. 1). In an exemplary case, the report can be employed by a customer as proof or evidence that a user on the customer's site initiated a false alarm accidentally as a result of an MCP test or that he user on the customer's site did or did not intentionally operate the frangible element 220 during a false alarm.

Figure 5:
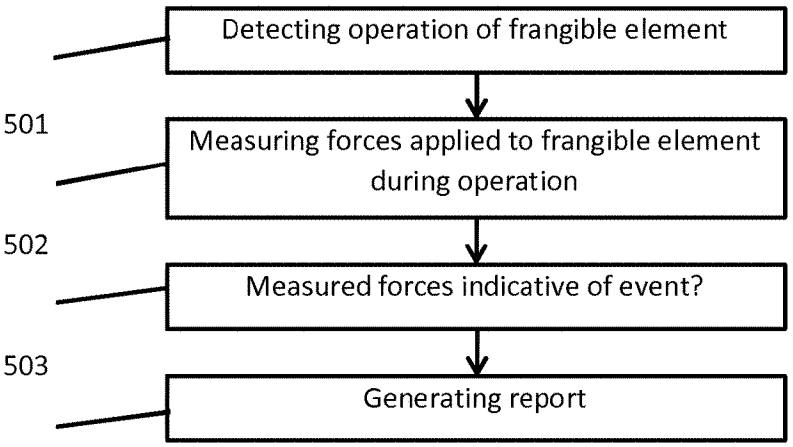
FIG. 5 is a flow diagram illustrating a manual call point (MCP) operational method in accordance with embodiments.

With reference to FIG. 5, an MCP operational method is provided. As shown in FIG. 5, the MCP operational method includes detecting an operation of a frangible element (501), measuring forces applied to the frangible element during the operation (502), determining whether the measured forces are indicative of an event (503) and generating a report in accordance with results of the determining (504).

Technical effects and benefits of the features described herein are the provision of a sensor (e.g., a MEMS accelerometer) in an MCP so that forces applied to the MCP components can be measured in order to determine whether the MCP is being activated intentionally or not during a test or an actual incident.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

The following clauses set out features of the disclosure which may or may not presently be claimed in this application but which may form the basis for future amendment or a divisional application.

1. A manual call point (MCP), comprising: a housing; a frangible element disposed on the housing to be accessible to and operable by a user; and a control system disposed within the housing and comprising: a detector configured to detect frangible element operations; a sensor configured to measure forces applied to the frangible element; and a processing unit configured to initiate an alarm responsive to the detector detecting a frangible element operation, to determine whether the measured forces are indicative of an event and to generate a report in accordance with determination results.

2. The MCP according to clause 1, wherein the housing is formed to define a test key point into which a test key is insertible for an MCP test and an MCP reset.

3. The MCP according to either of clauses 1 or 2, further comprising a circuit board disposed within the housing and on which the detector, the sensor and the processing unit are disposed.

4. The MCP according to any of clauses 1-3, wherein the detector comprises a micro-switch.

5. The MCP according to any of clauses 1-4, wherein the sensor comprises a micro-electromechanical systems (MEMS) accelerometer.

6. The MCP according to any of clauses 1-5, wherein the frangible element is movable in the frangible element operation from an initial position to a final position within the housing.

7. The MCP according to clauses 6, wherein the sensor measures forces applied to the frangible element in a first direction, which is in a plane of frangible element movement, and a second direction transverse to the first direction.

8. The MCP according to any of clauses 1-7, wherein the processing unit is configured to determine whether at least magnitudes and directions of the forces applied to the frangible element are indicative of: intentional user operation of the frangible element toward alarm initiation, an MCP test or reset, a malicious operation, and an external incident.

9. An alarm system for deployment in a space, the alarm system comprising: a central alarm and control system; and manual call points (MCPs) respectively deployed throughout the space and comprising: a housing; a frangible element disposed on the housing to be accessible to and operable by a user; and a control system disposed within the housing and comprising: a detector configured to detect an operation of the frangible element; a sensor configured to measure forces applied to the frangible element; and a processing unit communicative with the central alarm and control system and configured to cooperatively initiate an alarm responsive to the detector detecting a frangible element operation with the central alarm and control system, to determine whether the measured forces are indicative of an event and to generate a report in accordance with determination results.

10. The alarm system according to clause 9, wherein the housing is formed to define a test key point into which a test key is insertible for an MCP test and an MCP reset.

11. The alarm system according to either of clauses 9 or 10, further comprising a circuit board disposed within the housing and on which the detector, the sensor and the processing unit are disposed.

12. The alarm system according to any of clauses 9-11, wherein the detector comprises a micro-switch.

13. The alarm system according to any of clauses 9-12, wherein the sensor comprises a micro-electromechanical systems (MEMS) accelerometer.

14. The alarm system according to any of clauses 9-13, wherein the frangible element is movable in the frangible element operation from an initial position to a final position within the housing.

15. The alarm system according to clause 14, wherein the sensor measures forces applied to the frangible element in a first direction, which is in a plane of frangible element movement, and a second direction transverse to the first direction.

16. The alarm system according to any of clauses 9-15, wherein the processing unit is configured to determine whether at least magnitudes and directions of the forces applied to the frangible element are indicative of: intentional user operation of the frangible element toward alarm initiation, an MCP test or reset, a malicious operation, and an external incident.

17. A manual call point (MCP) operational method, comprising: detecting an operation of a frangible element; measuring forces applied to the frangible element during the operation; determining whether the measured forces are indicative of an event; and generating a report in accordance with results of the determining.

18. The MCP operational method according to clause 17, wherein: the frangible element is movable during the operation from an initial position to a final position within the housing, and the measuring of the forces applied to the frangible element during the operation comprises: measuring the forces applied in a first direction, which is in a plane of frangible element movement; and measuring the forces applied in a second direction transverse to the first direction.

19. The MCP operational method according to either of clauses 17 or 18, wherein the determining comprises determining whether at least magnitudes and directions of the forces applied to the frangible element are indicative of: intentional user operation of the frangible element toward alarm initiation, an MCP test or reset, a malicious operation, and an external incident.

20. The MCP operational method according to clause 19, wherein the determining comprises comparing the at least magnitudes and directions to historical magnitudes and directions of: intentional user operation of the frangible element toward alarm initiation, an MCP test or reset, a malicious operation, and an external incident.

The invention claimed is:

1. A manual call point (MCP), comprising:

a housing;

a frangible element disposed on the housing to be accessible to and operable by a user; and a control system disposed within the housing and comprising:

a detector configured to detect frangible element operations;

a sensor configured to measure forces applied to the frangible element; and a processing unit configured to initiate an alarm responsive to the detector detecting a frangible element operation, to determine whether at least magnitudes and directions of the measured forces are indicative of any one of intentional user operation of the frangible element toward alarm initiation, an MCP test or reset, a malicious operation and an external incident and to generate a report in accordance with determination results.

2. The MCP according to claim 1, wherein the housing is formed to define a test key point into which a test key is insertible for an MCP test and an MCP reset.

3. The MCP according to claim 1, further comprising a circuit board disposed within the housing and on which the detector, the sensor and the processing unit are disposed.

4. The MCP according to claim 1, wherein the detector comprises a micro-switch.

5. The MCP according to claim 1, wherein the sensor comprises a micro-electromechanical systems (MEMS) accelerometer.

6. The MCP according to claim 1, wherein the frangible element is movable in the frangible element operation from an initial position to a final position within the housing.

7. The MCP according to claim 6, wherein the sensor measures forces applied to the frangible element in a first direction, which is in a plane of frangible element movement, and a second direction transverse to the first direction.

8. The MCP according to claim 1, wherein the processing unit is configured to determine whether at least magnitudes and directions of the forces applied to the frangible element are indicative of:

intentional user operation of the frangible element toward alarm initiation, an MCP test or reset, a malicious operation, and an external incident.

9. An alarm system for deployment in a space, the alarm system comprising:

a central alarm and control system; and a plurality of MCPs respectively deployed throughout the space, wherein each MCP comprises a housing, a frangible element disposed on the housing to be accessible to and operable by a user and a control system disposed within the housing and comprising a detector configured to detect frangible element operations, a sensor configured to measure forces applied to the frangible element and a processing unit configured to initiate an alarm responsive to the detector detecting a frangible element operation, to determine whether the measured forces are indicative of an event and to generate a report in accordance with determination results, and wherein the processing unit of each MCP is communicative with the central alarm and control system and configured to cooperatively initiate the alarm with the central alarm and control system.

10. A manual call point (MCP) operational method, comprising:

detecting an operation of a frangible element, which is movable during the operation from an initial position to a final position;

measuring forces applied to the frangible element in a first direction, which is in a plane of frangible element movement, and in a second direction, which is transverse to the first direction, during the operation;

determining whether the measured forces are indicative of an event; and generating a report in accordance with results of the determining.

11. The MCP operational method according to claim 10, wherein the determining comprises determining whether at least magnitudes and directions of the forces applied to the frangible element are indicative of:

intentional user operation of the frangible element toward alarm initiation, an MCP test or reset, a malicious operation, and an external incident.

12. The MCP operational method according to claim 10, wherein the determining comprises comparing the at least magnitudes and directions to historical magnitudes and directions of:

intentional user operation of the frangible element toward alarm initiation, an MCP test or reset, a malicious operation, and an external incident.

13. The MCP operational method according to claim 10, wherein the determining comprises determining whether at least magnitudes and directions of the forces applied to the frangible element are indicative of any of:

intentional user operation of the frangible element toward alarm initiation, an MCP test or reset, a malicious operation, and an external incident.

14. The MCP operational method according to claim 10, wherein the determining comprises comparing the at least magnitudes and directions to historical magnitudes and directions of any of:

intentional user operation of the frangible element toward alarm initiation, an MCP test or reset, a malicious operation, and an external incident.

* * * * *